US008975820B2

(12) United States Patent
Seidmann

(10) Patent No.: US 8,975,820 B2
(45) Date of Patent: Mar. 10, 2015

(54) SMOOTH DIMMING OF SOLID STATE LIGHT SOURCE USING CALCULATED SLEW RATE

(71) Applicant: Koninklijke Philips N.V., Eindhoven (NL)

(72) Inventor: Jonathan Shai Seidmann, Brookline, MA (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/370,607

(22) PCT Filed: Jan. 2, 2013

(86) PCT No.: PCT/IB2013/050022

§ 371 (c)(1),
(2) Date: Jul. 3, 2014

(87) PCT Pub. No.: WO2013/102854

PCT Pub. Date: Jul. 11, 2013

(65) Prior Publication Data

US 2014/0375216 A1 Dec. 25, 2014

Related U.S. Application Data

(60) Provisional application No. 61/583,654, filed on Jan. 6, 2012.

(51) Int. Cl.
*H05B 37/02* (2006.01)
*H05B 33/08* (2006.01)

(52) U.S. Cl.
CPC ..... *H05B 33/0848* (2013.01)
USPC ..... 315/149; 315/224

(58) Field of Classification Search
USPC ..... 315/149, 224, 307
See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Blackwell et al. | |
| 8,441,210 | B2 * | 5/2013 | Shteynberg et al. | 315/308 |
| 2008/0224629 | A1 | 9/2008 | Melanson | |
| 2008/0224633 | A1 | 9/2008 | Melanson | |
| 2009/0184662 | A1 | 7/2009 | Given | |
| 2011/0074302 | A1 | 3/2011 | Draper | |
| 2011/0204803 | A1 | 8/2011 | Grotkowski | |
| 2013/0249439 | A1 * | 9/2013 | Shteynberg et al. | 315/307 |

* cited by examiner

*Primary Examiner* — Daniel D Chang
(74) *Attorney, Agent, or Firm* — Yuliya Mathis

(57) ABSTRACT

A method and system are provided for smoothly dimming a solid state light (SSL) source. The method includes measuring a dimming angle (S322) of a voltage received from a dimmer, determining a target brightness (S323) of light to be output by the SSL source corresponding to the dimming angle, determining a current brightness (S324) of light currently output by the SSL source, and determining a slew rate (S325) based on the current brightness and the target brightness. The current brightness of the light currently output by the SSL source is adjusted (S326) to the target brightness using the nonlinear slew rate.

20 Claims, 8 Drawing Sheets

SMOOTH DIMMING OF SOLID STATE LIGHT SOURCE USING CALCULATED SLEW RATE

TECHNICAL FIELD

The present invention is directed generally to control of dimmable solid state light sources. More particularly, various inventive methods and apparatuses disclosed herein relate to smoothly adjusting light output by a dimmable solid state light source in response to changes in a dimming angle.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects, for example, as discussed in detail in U.S. Pat. Nos. 6,016,038 and 6,211,626, which are hereby incorporated by reference.

In various conventional LED lighting fixtures, an onboard microprocessor must determine the requested brightness of light output by the LED light source by measuring dimming information provided by a dimmer. For example, dimming angle may be measured and used as an indicator of the requested brightness. However, the output of the dimmer may vary from one phase to the next, causing the input to the microprocessor to be noisy. When the input to the microprocessor is mapped directly to the brightness of the LED lighting fixture, the output light visibly flickers.

Thus, there is a need in the art for efficiently controlling the light output by an LED lighting fixture in response to changes in dimming angle, to enable smooth transitions among dimming levels, with no visible flicker or other negative effects.

SUMMARY

The present disclosure is directed to inventive method and apparatus for smoothly adjusting light output by a solid state light source in response to operation of a dimmer by continuously determining a slew rate for filtering the dimmer input.

Generally, in one aspect, the invention relates to a method for smoothly dimming a solid state light (SSL) source. The method includes measuring a dimming angle of a voltage received from a dimmer; determining a target brightness of light to be output by the SSL source corresponding to the dimming angle; determining a current brightness of light currently output by the SSL source; and determining a slew rate based on the current brightness and the target brightness. The current brightness of the light currently output by the SSL source is adjusted to the target brightness using the nonlinear slew rate.

In another aspect, the invention relates to a system for controlling a level of light output by an SSL source in response to a dimmer includes a dimming angle detector and a power converter. The dimming angle detector is configured to detect a dimming angle of the dimmer based on a rectified voltage from the dimmer, to calculate a slew rate based on a target brightness of light indicated by the detected dimming angle and a current brightness of light currently output by the solid state light source, and to generate a power control signal based on the dimming angle and the calculated slew rate. The power converter is configured to provide an output voltage to the SSL source in response to the rectified voltage from the dimmer and the power control signal from the dimming angle detector.

In yet another aspect, a computer readable medium storing computer code, executable by a processor, is provided for smoothly dimming an SSL source. The computer readable medium includes dimming angle code for detecting a dimming angle of a voltage received from a dimmer; target brightness code for determining a target brightness of light to be output by the SSL source corresponding to the dimming angle; current brightness code for determining a current brightness of light currently output by the SSL source; slew rate code for determining a slew rate based on the current brightness and the target brightness; and power control signal code for determining a power control signal based at least in part on the determined slew rate. The current brightness of the light output by the SSL source is smoothly adjusted to match the target brightness in response to the power control signal.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, microcontrollers, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Applicants have recognized and appreciated that it would be beneficial to provide a circuit capable of providing smooth dimming operations of LED or other solid state light sources, for example, to prevent flicker and/or visible jumps in light levels.

Thus, according to various embodiments, a slew rate control technique is used whereby the slew rate is determined and/or changes continuously, e.g., at a predetermined sampling rate, depending on the difference between the current brightness of light output by a solid state light source and the target brightness of light output by the solid state light source, as indicated by the dimmer setting. Controlling the slew rate enables smooth transition of light in response to dimmer operation, even when and otherwise removes flicker. This prevents fixture brightness from behaving erratically because the dimming angle supplied can be noisy from one phase to the next.

Figure 1:
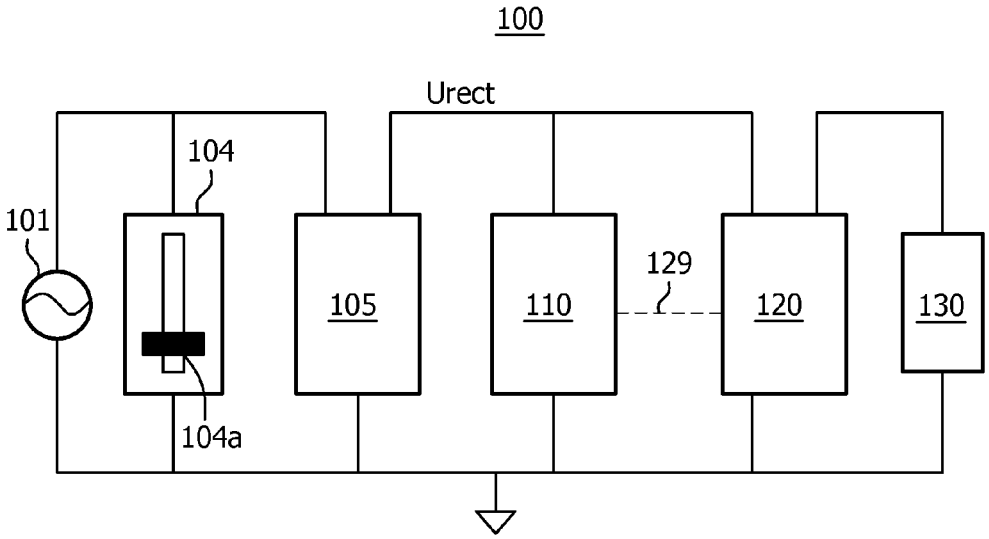
FIG. 1 is a simplified block diagram showing a dimmable lighting system, including a slew rate determination circuit, according to a representative embodiment.

FIG. 1 is a simplified block diagram showing a dimmable lighting system, including a slew rate determination circuit, according to a representative embodiment.

Referring to FIG. 1, dimmable lighting system 100 includes dimmer 104 and rectifier 105, which provides a (dimmed) rectified voltage Urect from voltage mains 101. The voltage mains 101 may provide different unrectified input AC line voltages, such as 100VAC, 120VAC, 230VAC and 277VAC, according to various implementations. The dimmer 104 is a phase chopping dimmer, or ELV dimmer, for example, which provides dimming capability by chopping leading edges (leading edge dimmer) or trailing edges (trailing edge dimmer) of voltage signal waveforms from the voltage mains 101 in response to vertical operation of its slider 104*a*. Generally, the magnitude of the rectified voltage Urect is proportional to the dimming level set by the dimmer 104, such that a lower dimming angle or dimming level results in a lower rectified voltage Urect. In the depicted example, the slider is moved downward to lower the dimming angle, reducing the amount of light output by solid state light source 130, and is moved upward to increase the dimming angle, increasing the amount of light output by the solid state light source 130, although various alternative configurations may be included.

The dimmable lighting system 100 further includes dimming angle detector 110 and power converter 120. Generally, the dimming angle detector 110 detects the dimming angle of the dimmer 104 based on the rectified voltage Urect, and outputs a power control signal via control line 129 to the power converter 120. The power control signal may be a pulse width modulation (PWM) signal or other digital signal, for example, and may alternate between high and low levels in accordance with a duty cycle determined by the dimming angle detector 110 based on the detected dimming angle. The duty cycle may range from about 100 percent (e.g., continually at the high level) to about zero percent (e.g., continually at the low level), and includes any percentage in between in order to adjust appropriately the power setting of the power converter 120 to control the level of light emitted by the solid state light source 130, as discussed below.

In various embodiments, the power converter 120 receives the rectified voltage Urect from the rectifier 105, and outputs a corresponding DC output voltage for powering the solid state light source 130. The power converter 120 converts between the rectified voltage Urect and the DC voltage based on the magnitude of the voltage output from the dimmer 104 via the rectifier 105 and/or the power setting value of the power control signal provided by the dimming angle detector 110 via control line 129. The magnitude of the voltage output from the dimmer 104 may be set by operation of the slider 104*a*.

The value of the power control signal is set by the dimming angle detector 110 in accordance with a predetermined control function or algorithm, including determination and application of a slew rate, according to various embodiments, discussed below with reference to FIG. 3. The DC voltage output by the power converter 120 thus reflects the dimming angle (i.e., the level of dimming) applied by the dimmer 104, as well as adjustments compensating for differences between the desired (or target) light output indicated by the dimming angle and the actual (or current) light presently output from the solid state light source 130. The function for converting between the rectified voltage Urect and the DC voltage may also depend on additional factors, such as properties of the power converter 120, the type and configuration of solid state light source 130, and other application and design requirements of various implementations, as would be apparent to one of ordinary skill in the art.

In various embodiments, the rectifier 105, the dimming angle detector 110, the power converter 120 and the solid state light source 130 may be included in a lighting unit, such as an LED lamp, which may be retrofit for use with conventional lamp sockets designed for incandescent light bulbs. Such a lighting unit may further include various optics (not shown), if needed, to meet design specific requirements, such as beam shaping and/or color influencing.

Figure 2A:
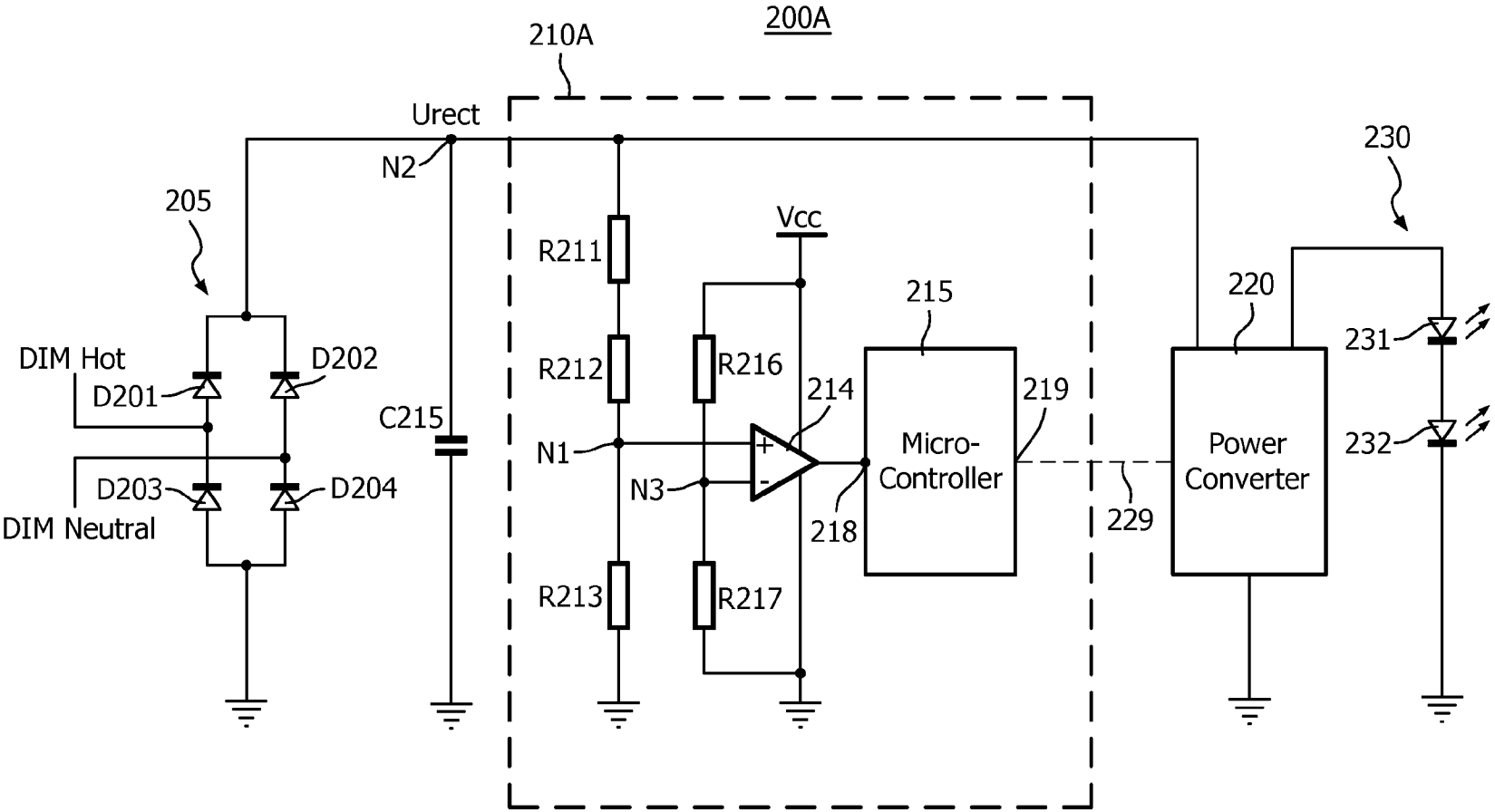
FIGS. 2A and 2B are simplified circuit diagrams showing a dimmable lighting system, including a slew rate determination circuit, according to representative embodiments.
Figure 2B:
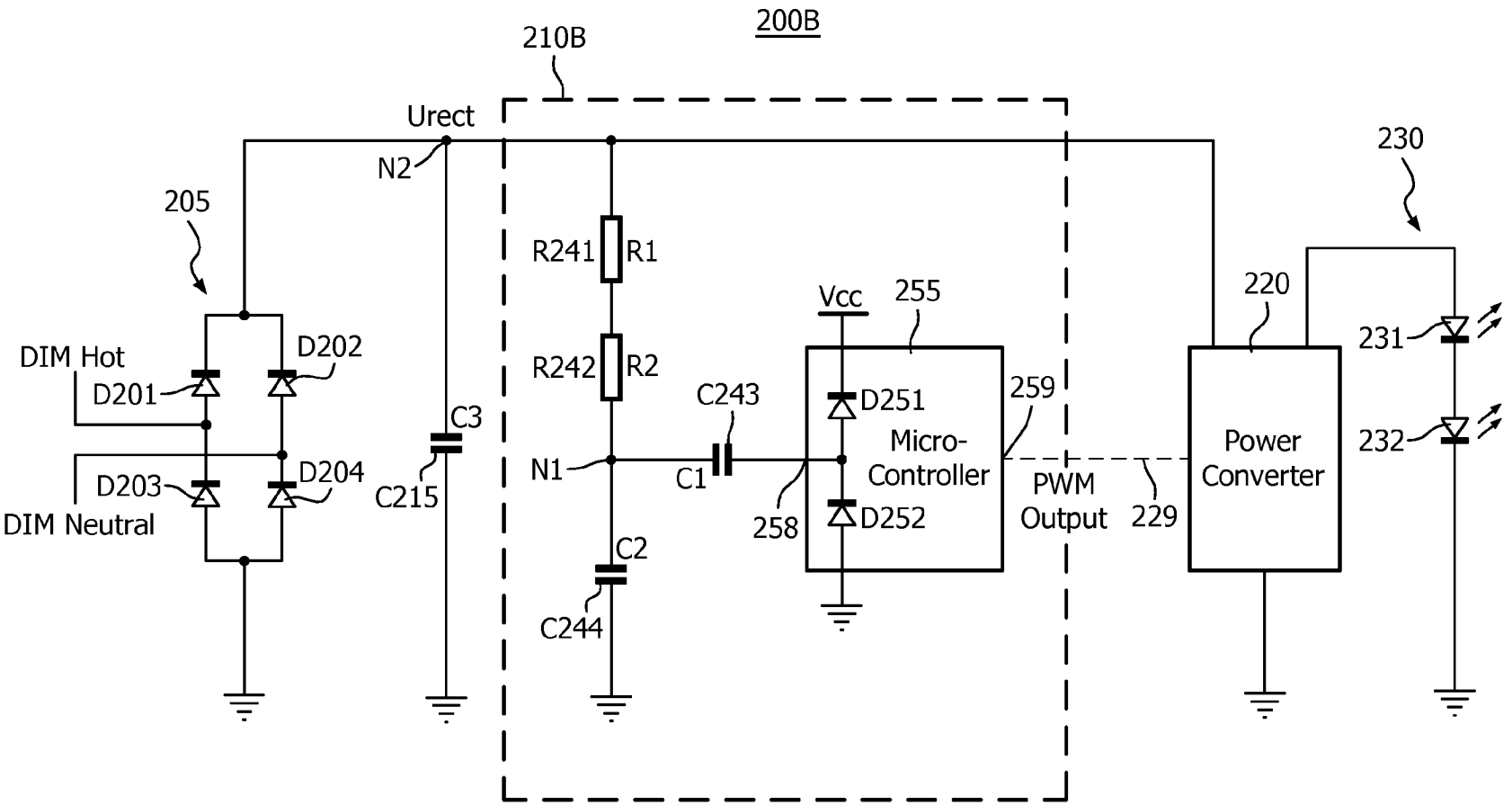

FIGS. 2A and 2B are simplified circuit diagrams showing a dimming control system, including a slew rate determination circuit, according to representative embodiments. The general components of FIGS. 2A and 2B are similar to those of FIG. 1, although more detail is provided with respect to various representative components, in accordance with illustrative configurations. Of course, other configurations may be implemented without departing from the scope of the present teachings.

Referring to FIG. 2A, for purposes of explanation, dimming control system 200A includes rectifier 205, dimming angle detector 210A (dashed box), power converter 220 and LED light source 230. As discussed above with respect to the rectifier 105, the rectifier 205 is connected to a dimmer (not shown), indicated by the dim hot and dim neutral inputs to receive (dimmed) unrectified voltage from the voltage mains (not shown). In the depicted configuration, the rectifier 205 includes four diodes D201-D204 connected between rectified voltage node N2 and ground voltage. The rectified voltage node N2 receives the (dimmed) rectified voltage Urect, and is connected to ground through input filtering capacitor C215 connected in parallel with the rectifier 205.

The dimming angle detector 210A detects the dimming angle (level of dimming) based on the rectified voltage Urect, and determines a slew rate based on the detected dimming angle and amount of light currently output by the LED light source 230. The desired amount of light to be output by the LED light source 230 (indicated by the dimming angle) may be referred to as "target brightness," and the amount of light currently output by the LED light source 230 may be referred to as "current brightness." The slew rate may be nonlinear, such that relatively small changes to the dimming angle, for example, caused by dimmer noise and/or minor adjustments to dimmer settings, cause slow changes to the current brightness of the of light output by the LED light source 230, and relatively large changes to the dimming angle, for example, caused by significant or large step adjustments to the dimming angle, cause rapid (yet smooth) changes to the current brightness.

The dimming angle detector 210A outputs a digital power control signal from digital or PWM output 219 via control line 229 to the power converter 220 to control operation of the LED light source 230. This allows the dimming angle detector 210A to adjust selectively the amount of power delivered from the input mains to the LED light source 230 based on the detected dimming angle, as well as the slew rate, which may be calculated continuously. In the depicted representative embodiment, the power control signal is a PWM signal having a duty cycle, determined by the dimming angle detector 210A, corresponding to a power setting to be provided to the power converter 220.

Also, in the depicted representative embodiment, the dimming angle detector 210A includes microcontroller 215, which uses waveforms of the rectified voltage Urect to determine the dimming angle and outputs the PWM power control signal through PWM output 219. In various embodiments, the microcontroller 215 may be an ATtiny 84 microprocessor, available from Atmel Corporation, for example, although other types of microcontrollers or other processors may be included without departing from the scope of the present teachings. For example, the functionality of the microcontroller 215 may be implemented by one or more processors and/or controllers, and corresponding memory, which may be programmed using software or firmware to perform the various functions, or may be implemented as a combination of dedicated hardware to perform some functions and a processor (e.g., one or more programmed microprocessors and associated circuitry) to perform other functions. Examples of controller components that may be employed in various embodiments include, but are not limited to, conventional microprocessors, microcontrollers, ASICs and FPGAs, as discussed above.

The power converter 220 receives the rectified voltage Urect at the rectified voltage node N2, and converts the rectified voltage Urect to a corresponding DC voltage for powering the LED light source 230, under control of the PWM power control signal provided by the dimming angle detector 210A. In various embodiments, the power converter 220 may be an L6562, available from ST Microelectronics, for example, although other types of power converters or other electronic transformers and/or processors may be included without departing from the scope of the present teachings. The LED light source 230 includes a string of LEDs connected in series, indicated by representative LEDs 231 and 232, between an output of the power converter 220 and ground. The amount of load current through the LED light source 230, and thus the amount of light emitted by the LED light source 230, is controlled directly by the amount of power output by the power converter 220. As mentioned above, the amount of power output by the power converter 220 is controlled by the magnitude of the rectified voltage Urect and the PWM power control signal provided by the dimming angle detector 210A.

Figure 3:
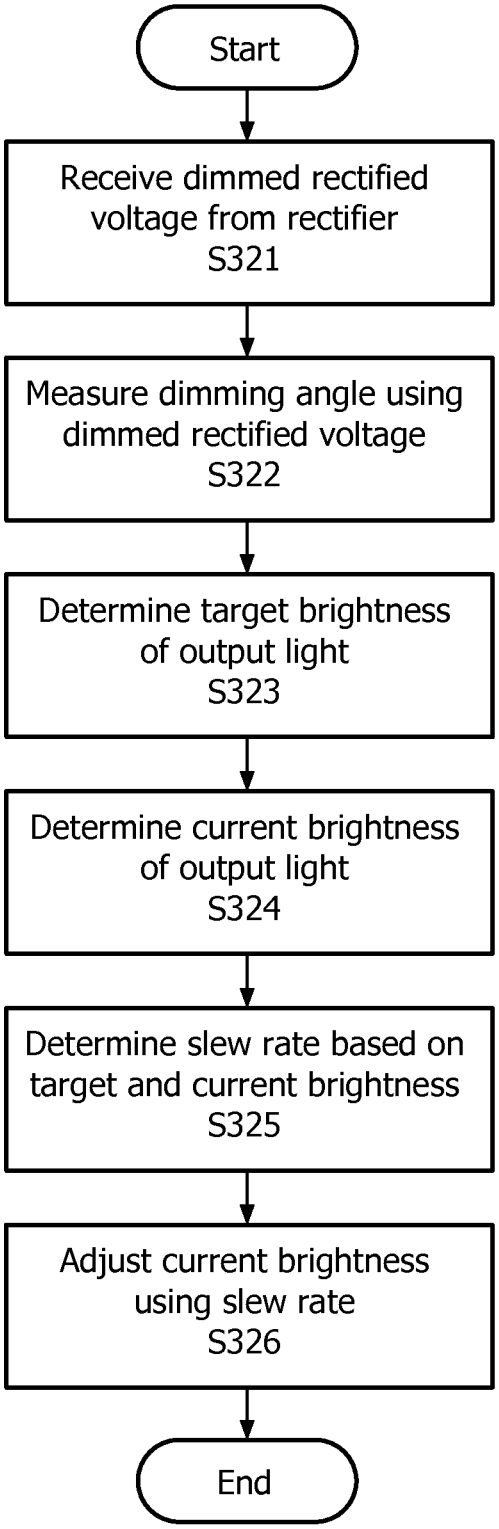
FIG. 3 is a flow diagram showing dimming control of a solid state light source using slew rate determination, according to a representative embodiment.

FIG. 3 is a flow diagram showing dimming control of a solid state light source using slew rate determination, according to a representative embodiment. The operations shown in FIG. 3 may be implemented, for example, by firmware and/or software executed by the microcontroller 215, 255 shown in FIGS. 2A, 2B, for example, or more generally by the dimming angle detector 110, 210A, 210B, although other implementations may be incorporated without departing from the scope of the present teachings.

Referring to FIG. 3, a dimmed rectified voltage is received (e.g., by the dimming angle detector 210A, 210B and/or the microcontroller 215, 255) in operation S321. The dimmed rectified voltage may have a chopped waveform, for example, that corresponds to the level of dimming set at the dimmer. The dimming angle is measured in operation S322 based on the dimmed rectified voltage. Illustrative processes for measuring the dimming angle are discussed below with reference to FIGS. 5A-5C, 6 and 7, below, although any dimming angle measurement technique may be incorporated without departing from the scope of the present teachings.

The target brightness of the light to be output by the solid state light source (e.g., solid state light source 120, LED light source 230) is determined in operation S323, based on the dimming angle measured in operation S322. In operation S324, the current brightness of light currently being output by the solid state light source is determined. For example, in order to determine the current brightness, the microcontroller 215 simply may rely on the brightness setting currently being applied (e.g., via the digital power control signal) or may retrieve the brightness setting from memory. Alternatively, the microcontroller 215 may receive feedback from the power controller 220 and/or the LED light source 230 indicating the amount of light actually being output by the LED light source 230. Further, it is understood that the target brightness and the current brightness may be determined in any order or simultaneously.

In operation S325, a slew rate is determined based on the target brightness and the current brightness determined in operations S323 and S324. For example, the slew rate may be calculated according to Equation (1), in which SR is the slew rate, Bc is the current brightness, Bt is the target brightness, and N is a normalization constant:

$$SR = \frac{(Bc - Bt)^2}{N} \qquad \text{Equation (1)}$$

The absolute value of the difference between the current brightness (Bc) and the target brightness (Bt) may be referred to as the "brightness error." The value of the normalization constant N is selected to manipulate the slew rate to attain a desired response. Generally, the normalization constant N is a predetermined value used to bring large slew rate values into a realistic range for operation of the power controller 220 and/or the LED light source 230. For example, the normalization constant may be set to a value of 5000. Of course, other values of the normalization constant N may be incorporated to provide unique benefits for any particular situation or to meet application specific design requirements of various implementations, as would be apparent to one skilled in the art. The value of the normalization constant N depends in part on the frequency at which the slew rate is calculated, discussed below, as well as the resolution of the light output by the LED light source 230. Of course, other formulas may be applied for calculating the slew rate in operation S325, without departing from the scope of the present teachings.

In operation S326, the current brightness of the light output by the LED light source 230 is adjusted using the slew rate determined in operation S326. According to various embodiments, the current brightness is adjusted smoothly, in that there is no visible flicker during the adjustment and/or there are no large steps or jumps in the level of the light output by the solid state lighting load, otherwise known as the "rubber band" effect.

In an embodiment, the slew rate is controlled continuously, in that the value of the slew rate is repeatedly calculated several times per second in order to provide smooth adjustments to the current brightness. More particularly, the slew rate may be calculated and applied at approximately the same rate as the dimming angle is determined. For example, the microcontroller 215 may measure the dimming angle (in operation S322) during every half cycle of the AC line voltage, which is approximately 100-120 times per second for a 120VAC line voltage. Therefore, the microcontroller 215 is able to determine a new slew rate and update its output power control signal accordingly at a similar rate, i.e., approximately 100 times per second. Of course, the microcontroller 215 may measure the dimming angle (in operation S322) more frequently than every half cycle of the AC line voltage, which generally provides a smoother appearance to changes in the current brightness of the output light. In response to the updated power control signal, the power controller 220 adjusts the current brightness of the light output by the LED light source 230. By selecting the slew rate technique intelligently, there is a small hysteretic element, in that the target brightness must change by at least a certain minimum amount in order for the current brightness to change at all. The current brightness of the LED light source 230 thus changes smoothly in much the same way as an incandescent light, and there is no visible flickering which occurs.

When the slew rate is nonlinear, as in the example discussed with regard to Equation (1), the current brightness of the light output by the solid state light source is more responsive to the dimming angle when the dimmer setting is being moved rapidly. In other words, the solid state light source is controlled to change the current brightness of the output light more quickly when a large step in the dimmer setting occurs. Also, as mentioned above, small changes, e.g., caused by dimmer noise or small steps in the dimmer setting, result in very slow changes to the current brightness, and under certain circumstances, no change in current brightness at all, e.g., when the changes are below a threshold supported by the hardware. Accordingly, the various embodiments prevent random noise from changing the current brightness. An example of a large step in the dimmer setting is a substantially instantaneous change of about 20 percent or more in the target brightness, and an example of a small step in the dimmer setting is a substantially instantaneous change of about 5 percent or less in the target brightness.

Figure 4:
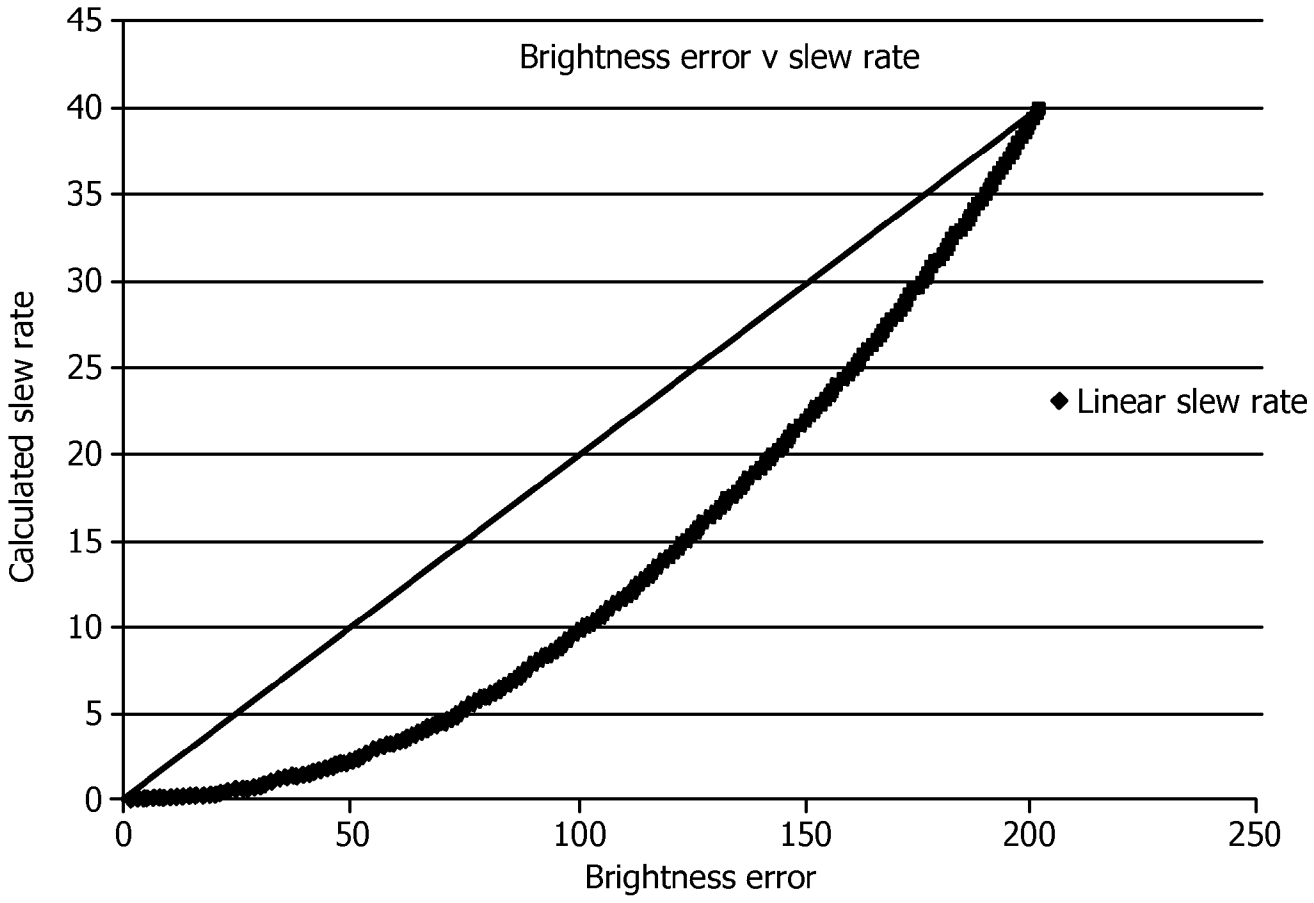
FIG. 4 shows curves illustrating brightness error versus slew rate, according to representative embodiments.

FIG. 4 is a graph including curves illustrating brightness error versus slew rate, according to a representative embodiment.

Referring to FIG. 4, curves 410 and 420 show corresponding slew rate values as functions of brightness error. As discussed above, the brightness error is the absolute value of the difference between current brightness and target brightness of light output by a solid state light source. Curve 410 depicts a linear relationship between the slew rate and the brightness error, while curve 420 depicts a nonlinear relationship between the slew rate and the brightness error, as discussed above with regard to Equation (1).

Referring again to FIG. 3, operation S322 provides for detecting or measuring the dimming angle of the dimmer based on the rectified voltage Urect received by the dimming angel detector 210A, 210B. As mentioned above, measuring the dimming angle may be accomplished in various ways, without departing from the scope of the present teachings. Two illustrative methods of determining the dimming angle are discussed below with reference to the representative embodiments depicted in FIGS. 2A and 2B.

FIG. 2A is a simplified circuit diagram showing a dimming angle detector of a dimmable lighting system, according to a representative embodiment. In FIG. 2A, the dimming angle detector 210A includes the microcontroller 215, which uses waveforms of the rectified voltage Urect to determine the dimming angle. The microcontroller 215 includes digital input pin 218 connected to an output of comparator 214. The comparator 214 may be an operation amplifier, for example, and includes a positive input connected to a first voltage divider to receive the (dimmed) rectified voltage Urect, and a negative input connected to a second voltage divider to receive a reference voltage for comparing to the rectified voltage Urect. The microcontroller 215 also includes a digital output, such as PWM output 219.

The first voltage divider includes first and second resistors R211 and R212 connected in series between the rectified voltage node N2 and a first input node N1, and third resistor R213 connected between the detection node N1 and ground. The second voltage divider includes fourth resistor R216 connected between voltage source Vcc and a second input node N3, and fifth resistor R217 connected between the second input node N3 and ground. In the depicted embodiment, the first resistor R211 may have a value of about 1 megohm, the second resistor R212 may have a value of about 1 megohm, the third resistor R213 may have a value of about 20 kohm, the fourth resistor R216 may have a value of about 50 kohm, and the fifth resistor R217 may have a value of about 12 kohm, for example. However, the respective values of the first through fifth resistors R211, R212, R213, R216 and R217 may vary to provide unique benefits for any particular situation or to meet application specific design requirements of various implementations, as would be apparent to one of ordinary skill in the art. Generally, the first, second and third resistors R211, R212 and R213 divide the AC voltage values down to a voltage range that can be processed by the comparator 214, and the fourth and fifth resistors R216 and R217 create a reference voltage for the comparator 214 which allows the dimming angle to be read easily. For example, the first, second and third resistors R211, R212 and R213 may divide the AC voltage values to less than 5V for full AC voltage operation (e.g., 277 VAC), and the fourth and fifth resistors may provide a 2.5V reference for a square output signal.

The first voltage divider limits the amount of (dimmed) rectified voltage Urect provided to the positive input of the comparator 214, and the second voltage divider provides a predetermined reference voltage (e.g., 2.5V) to the negative input of the comparator 214. When a signal waveform of the rectified voltage Urect goes high (e.g., greater than the reference voltage), the comparator outputs a high voltage level ("1"), and when the signal waveform of the rectified voltage Urect goes low (e.g., less than the reference voltage), the comparator outputs a low voltage level ("0"), for example. Accordingly, the resulting logic level digital pulse at the digital input pin 218 of the microcontroller 215 closely follows the movement of the chopped rectified voltage Urect, examples of which are shown in FIGS. 5A-5C.

Figure 5A:
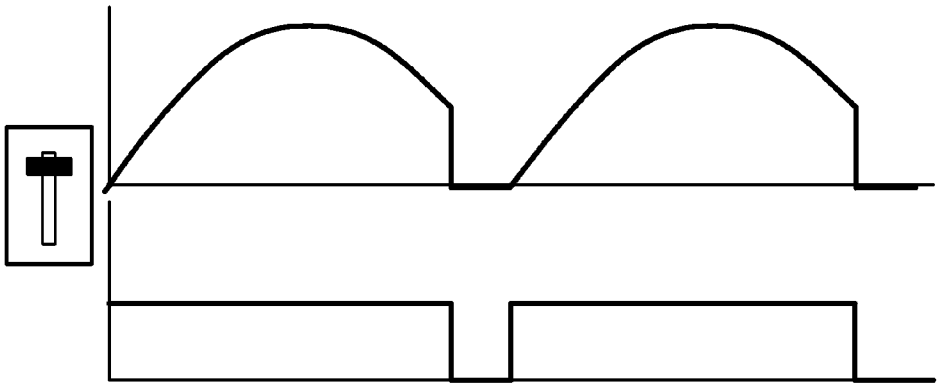
FIGS. 5A-5C show sample waveforms and corresponding digital pulses of a dimmer, according to a representative embodiment.
Figure 5B:
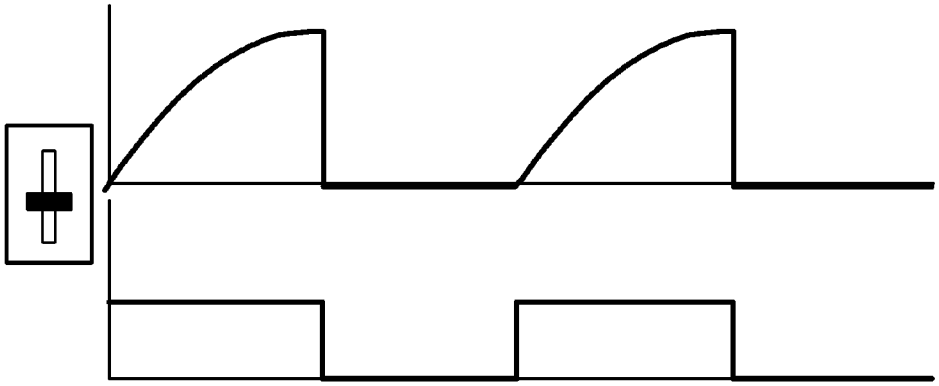
Figure 5C:
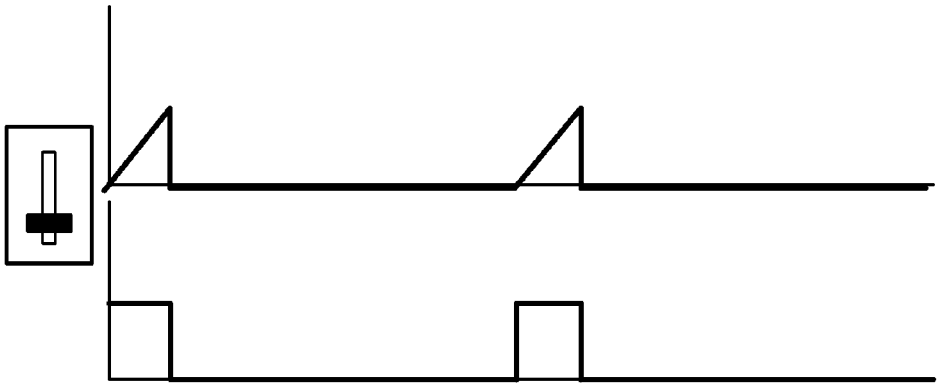

More particularly, FIGS. 5A-5C show sample waveforms and corresponding digital pulses at the digital input pin 218, according to representative embodiments. The top waveforms in each figure depict the chopped rectified voltage Urect, where the amount of chopping reflects the level of dimming. For example, the waveforms may depict a portion of a full 170V (or 340V for E.U.) peak, rectified sine wave that appears at the output of the dimmer. The bottom square waveforms depict the corresponding digital pulses seen at the digital input pin 218 of the microcontroller 215. Notably, the length of each digital pulse corresponds to a chopped waveform, and thus is equal to the amount of time the dimmer's internal switch is "on." By receiving the digital pulses via the digital input pin 218, the microcontroller 215 is able to determine the level to which the dimmer has been set (i.e., the dimming angle).

FIG. 5A shows a sample waveform of rectified voltage Urect and corresponding digital pulses when the dimmer is at its highest setting, indicated by the top position of the dimmer slider shown next to the waveform. FIG. 5B shows a sample waveform of rectified voltage Urect and corresponding digital pulses when the dimmer is at a medium setting, indicated by the middle position of the dimmer slider shown next to the waveform. FIG. 5C shows a sample waveform of rectified voltage Urect and corresponding digital pulses when the dimmer is at its lowest setting, indicated by the bottom position of the dimmer slider shown next to the waveform.

Figure 6:
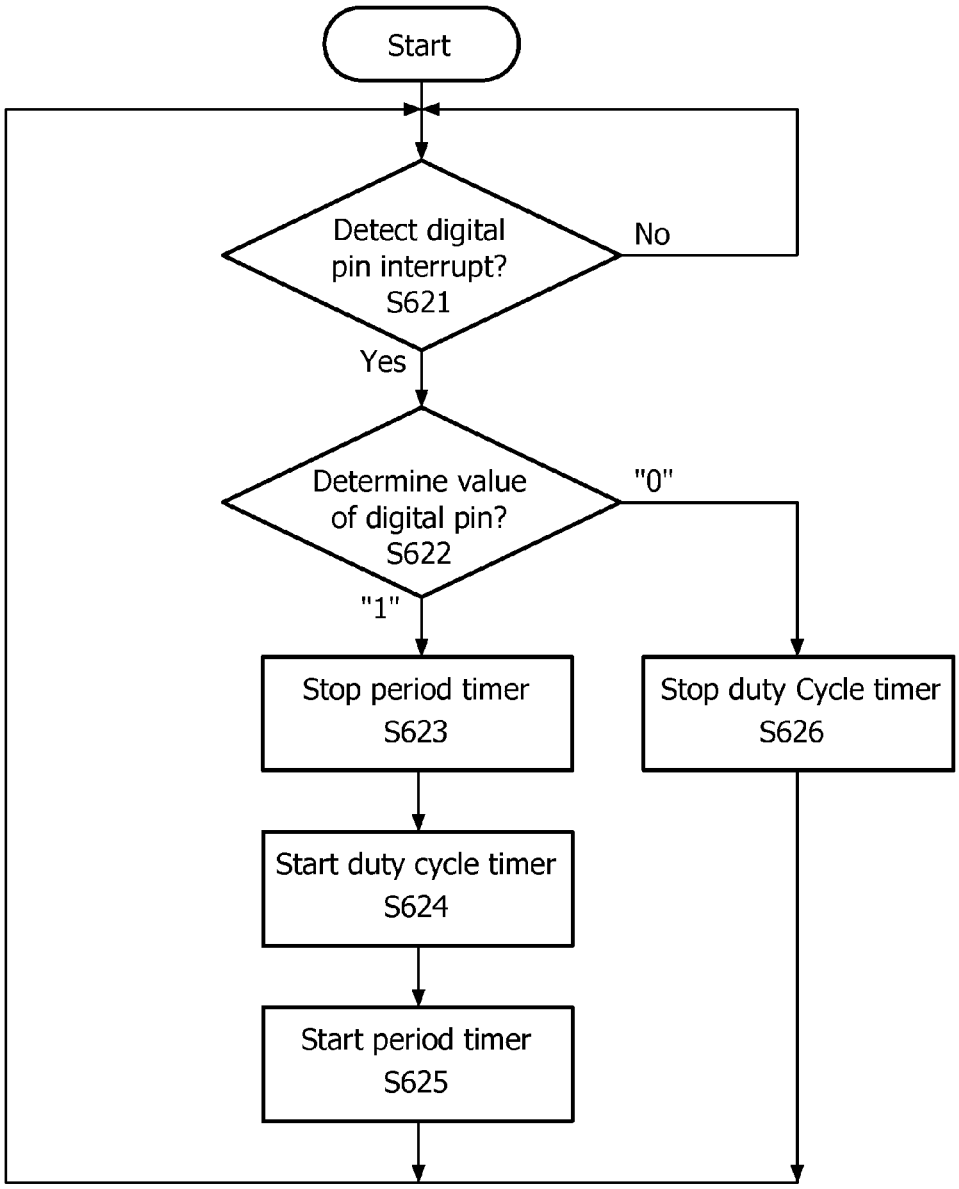
FIG. 6 is a flow diagram showing a process of detecting dimming angle of a dimmer, according to a representative embodiment.

FIG. 6 is a flow diagram showing a process of detecting the dimming of a dimmer, according to a representative embodiment. The process may be implemented by firmware and/or software executed by the microcontroller 215 shown in FIG. 2A, for example, or more generally by the dimming angle detector 110, 210A.

In operation S621 of FIG. 6, the digital input pin 218 of the microcontroller 215 is monitored to detect a digital pin interrupt. The digital pin interrupt indicates a change in voltage level of the output of the comparator 214, either from a low voltage level to a high voltage level or from a high voltage level to a low voltage level. When no interrupt is detected (operation S621: No), the monitoring continues.

When an interrupt is detected (operation S621: Yes), it is determined in operation S622 whether the value of the digital pin 218 is at a high voltage level (digital "1") or a low voltage level (digital "0") at the time the interrupt is detected. When the value of the digital pin 218 is "1", this indicates the end of one period and the beginning of the next period, as well as the start of a duty cycle. Therefore, a period timer is stopped in operation S623, corresponding to the end of the period. Also, a duty cycle timer is started in operation S624 corresponding to the beginning the next duty cycle and the period time is started again in operation S625 corresponding to the beginning of the next period. When the value of the digital pin 218 is "0" in operation S622, this indicates the end of the duty cycle. Therefore, the duty cycle timer is stopped in operation S626, corresponding to the end of the duty cycle within the current period. The process returns to operation S621 to continue monitoring the digital input pin 218.

The value of the duty cycle within the period gives the microcontroller 215 an accurate indication of the level to which the dimmer has been set or the dimming angle of the dimmer. That is, the smaller the duty cycle, the larger the dimming angle (e.g., as shown by the waveform in FIG. 5C) and the larger the duty cycle, the smaller the dimming angle (e.g., as shown by the waveform in FIG. 5A). In various embodiments, the dimming angle may be calculated, e.g., by the microcontroller 215, using a predetermined function of the counter value, where the function may vary in order to provide unique benefits for any particular situation or to meet application specific design requirements of various implementations, as would be apparent to one of ordinary skill in the art.

FIG. 2B is a simplified circuit diagram showing a dimming angle detector of a dimmable lighting system, according to another representative embodiment, in which like reference numerals refer to like components of FIG. 2A. In FIG. 2B, the dimming angle detector 210B includes the microcontroller 255, which uses waveforms of the rectified voltage Urect to determine the dimming angle. The microcontroller 255 may be a ATTINY 84 microprocessor, available from Atmel Corporation, for example, although other types of microcontrollers or other processors may be included without departing from the scope of the present teachings. The microcontroller 255 includes digital input pin 258 connected between a top diode D251 and a bottom diode D252. The top diode D251 has an anode connected to the digital input pin 258 and a cathode connected to voltage source Vcc, and the bottom diode D252 has an anode connected to ground and a cathode connected to the digital input pin 258. The microcontroller 255 also includes a digital output, such as PWM output 259 for providing power control signal via power control line 229.

The dimming angle detector 210B further includes various passive electronic components, such as first and second capacitors C243 and C244, and first and second resistors R241 and R242. The first capacitor C243 is connected between the digital input pin 258 of the microcontroller 255 and a detection node N1. The second capacitor C244 is connected between the detection node N1 and ground. The first and second resistors R241 and R242 are connected in series between the rectified voltage node N2 and the detection node N1. In the depicted embodiment, the first capacitor C243 may have a value of about 560 pF and the second capacitor C244 may have a value of about 10 pF, for example. Also, the first resistor R241 may have a value of about 1 megohm and the second resistor R242 may have a value of about 1 megohm, for example. However, the respective values of the first and second capacitors C243 and C244, and the first and second resistors R241 and R242 may vary to provide unique benefits for any particular situation or to meet application specific design requirements of various implementations, as would be apparent to one of ordinary skill in the art.

The (dimmed) rectified voltage Urect is AC coupled to the digital input pin 258 of the microcontroller 255. The first resistor R241 and the second resistor R242 limit the current into the digital input pin 258. When a signal waveform of the rectified voltage Urect goes high, the first capacitor C243 is charged on the rising edge through the first and second resistors R241 and R242. The top diode D251 inside the microcontroller 255 clamps the digital input pin 258 one diode drop above Vcc, for example. On the falling edge of the signal waveform of the rectified voltage Urect, the first capacitor C243 discharges and the digital input pin 258 is clamped to one diode drop below ground by the bottom diode D252. Accordingly, the resulting logic level digital pulse at the digital input pin 258 of the microcontroller 255 closely follows the movement of the chopped rectified voltage Urect, examples of which are shown in FIGS. 5A-5C, discussed above.

Figure 7:
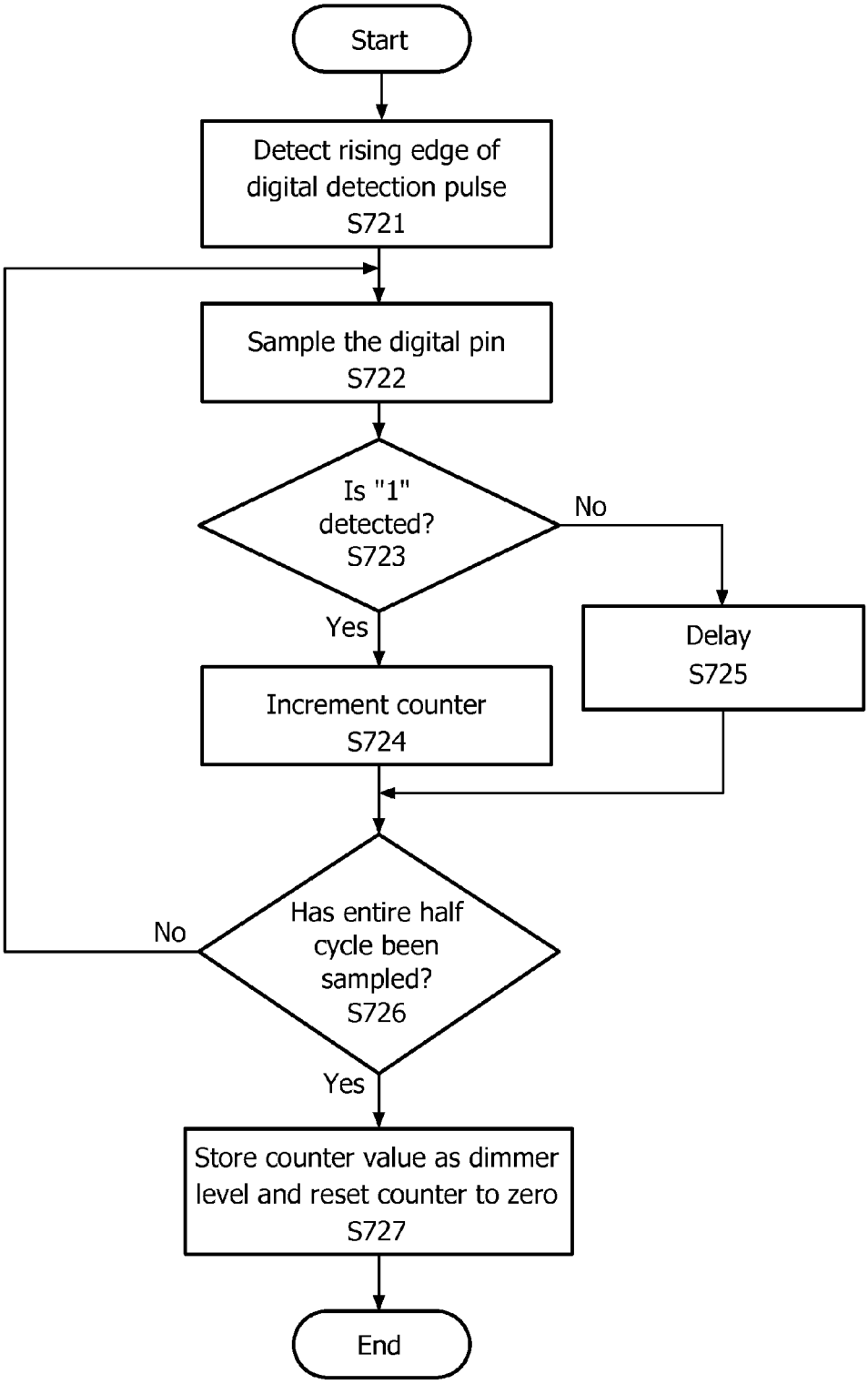
FIG. 7 is a flow diagram showing a process of detecting dimming angle of a dimmer, according to another representative embodiment.

FIG. 7 is a flow diagram showing a process of detecting the dimming of a dimmer, according to a representative embodiment. The process may be implemented by firmware and/or software executed by the microcontroller 255 shown in FIG. 2B, for example, or more generally by the dimming angle detector 110, 210B.

In operation S721 of FIG. 7, a rising edge of a digital pulse of an input signal (e.g., indicated by rising edges of the bottom waveforms in FIGS. 5A-5C) is detected, and sampling at the digital input pin 258 of the microcontroller 255, for example, begins in block S722. In the depicted embodiment, the signal is sampled digitally for a predetermined time equal to just under a mains half cycle. Each time the signal is sampled, it is determined in block S723 whether the sample has a high level (e.g., digital "1") or a low level (e.g., digital "0"). In the depicted embodiment, a comparison is made in block S723 to determine whether the sample is digital "1." When the sample is digital "1" (block S723: Yes), a counter is incremented in block S724, and when the sample is not digital "1" (block S723: No), a small delay is inserted in block S725. The delay is inserted so that the number of clock cycles (e.g., of the microcontroller 255) is equal regardless of whether the sample is determined to be digital "1" or digital "0."

In block S726, it is determined whether the entire mains half cycle has been sampled. When the mains half cycle is not complete (block S726: No), the process returns to block S722 to again sample the signal at the digital input pin 218. When the mains half cycle is complete (block S726: Yes), the sampling stops and the counter value (accumulated in block S724) is identified as the current dimmer phase angle or dimming level in block S727, which is stored, e.g., in a memory, examples of which are discussed above. The counter is reset to zero, and the microcontroller 255 waits for the next rising edge to begin sampling again.

For example, it may be assumed that the microcontroller 255 takes 255 samples during a mains half cycle. When the dimming level is set by the slider at the top of its range (e.g., as shown in FIG. 5A), the counter will increment to about 255 in block S724 of FIG. 7. When the dimming level is set by the slider at the bottom of its range (e.g., as shown in FIG. 5C), the counter will increment to only about 10 or 20 in block S724. When the dimming level is set somewhere in the middle of its range (e.g., as shown in FIG. 5B), the counter will increment to about 128 in block S724. The value of the counter thus gives the microcontroller 255 an accurate indication of the level to which the dimmer has been set or the dimming angle of the dimmer. In various embodiments, the dimming angle may be calculated, e.g., by the microcontroller 255, using a predetermined function of the counter value, where the function may vary in order to provide unique benefits for any particular situation or to meet application specific design requirements of various implementations, as would be apparent to one of ordinary skill in the art.

Accordingly, the dimming angle may be electronically detected, using minimal passive components and a digital input structure of a microcontroller (or other processor or processing circuit). In an embodiment, the dimming angle detection is accomplished using an AC coupling circuit, a microcontroller diode clamped digital input structure and an algorithm (e.g., implemented by firmware, software and/or hardware) executed to determine the dimmer setting level. Additionally, the condition of the dimmer may be measured with minimal component count and taking advantage of the digital input structure of a microcontroller.

The dimming control system, including the dimming angle detection circuit and the power controller, and the associated algorithm(s), may use the detected dimming angle to implement a slew rate, as discussed above. According to various embodiments, the slew rate may be determined (and changed) continuously, depending on differences between the current brightness and the target brightness of light output by a solid state lighting load. By applying the slew rate, the dimmer output is effectively filtered, thereby removing visible flicker and/or preventing large steps ("rubber band" effect) in the level of the light output by the solid state lighting load.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims between parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A method for smoothly dimming a solid state light (SSL) source, comprising:

measuring a dimming angle of a voltage received from a dimmer;

determining a target brightness of light to be output by the SSL source corresponding to the dimming angle;

determining a current brightness of light currently output by the SSL source;

determining a slew rate based on the current brightness and the target brightness; and adjusting the current brightness of the light currently output by the SSL source to the target brightness using the nonlinear slew rate.

2. The method of claim 1, wherein determining the slew rate comprises calculating a brightness error based on a difference between the current brightness and the target brightness, and determining the slew rate based on the brightness error.

3. The method of claim 2, wherein the slew rate is determined according to the following formula, wherein SR is the slew rate, Bc is the current brightness, Bt is the target brightness and N is a normalization constant:

$$SR = \frac{(Bc - Bt)^2}{N}.$$

4. The method of claim 3, wherein the normalization constant N is set to a value of approximately 5000.

5. The method of claim 1, wherein small changes to the target brightness caused by dimmer noise cause no change to the current brightness.

6. The method of claim 1, wherein large changes to the target brightness caused by large step adjustments to the dimming angle cause rapid changes to the current brightness.

7. The method of claim 1, wherein the slew rate is determined at approximately the same rate as the dimming angle is measured.

8. The method of claim 7, wherein the dimming angle is measured every half cycle of an AC line voltage.

9. The method of claim 8, wherein the slew rate is determined at a rate of approximately 100 times per second.

10. A system for controlling a level of light output by a solid state light source in response to a dimmer, the system comprising:

a dimming angle detector configured to detect a dimming angle of the dimmer based on a rectified voltage from the dimmer, to calculate a slew rate based on a target brightness of light indicated by the detected dimming angle and a current brightness of light currently output by the solid state light source, and to generate a power control signal based on the dimming angle and the calculated slew rate; and a power converter configured to provide an output voltage to the solid state light source in response to the rectified voltage from the dimmer and the power control signal from the dimming angle detector.

11. The system of claim 10, wherein the dimming angle detector is configured to calculate the slew rate continuously.

12. The system of claim 11, wherein the slew rate is non-linear.

13. The system of claim 12, wherein the dimming angle detector is further configured to determine the slew rate according to the following formula, wherein SR is the slew rate, Bc is the current brightness, Bt is the target brightness and N is a predetermined normalization constant:

$$SR = \frac{(Bc - Bt)^2}{N}.$$

14. The system of claim 11, wherein the dimming angle detector is further configured to detect the dimming angle and to calculate the slew rate based on the detected dimming angle approximately every half cycle of an AC line voltage.

15. The system of claim 11, wherein the power control signal comprises a pulse width modulation (PWM) signal, a duty cycle of the PWM signal indicating a level of the output voltage provided by the power converter.

16. A computer readable medium storing computer code, executable by a processor, for smoothly dimming a solid state light (SSL) source, the computer readable medium comprising:

dimming angle code for detecting a dimming angle of a voltage received from a dimmer;

target brightness code for determining a target brightness of light to be output by the SSL source corresponding to the dimming angle;

current brightness code for determining a current brightness of light currently output by the SSL source;

slew rate code for determining a slew rate based on the current brightness and the target brightness; and power control signal code for determining a power control signal based at least in part on the determined slew rate, wherein the current brightness of the light output by the SSL source is smoothly adjusted to match the target brightness in response to the power control signal.

17. The computer readable medium of claim 16, wherein the slew rate code calculates a brightness error based on a difference between the current brightness and the target brightness, and determines the slew rate based on the brightness error.

18. The computer readable medium of claim 17, wherein the slew rate code determines the slew rate according to the following formula, wherein SR is the slew rate, Bc is the current brightness, Bt is the target brightness and N is a normalization constant:

$$SR = \frac{(Bc - Bt)^2}{N}.$$

19. The computer readable medium of claim 16, wherein, in response to the power control signal, small changes to the target brightness caused by dimmer noise cause no change to the current brightness, and large changes to the target brightness caused by large step adjustments to the dimming angle cause rapid changes to the current brightness.

20. The computer readable medium of claim 16, wherein the dimming angle code detects the dimming angle and the slew rate code determines the slew rate based at approximately the same rate.

* * * * *